United States Patent [19]

Leveskis

[11] 3,988,121

[45] Oct. 26, 1976

[54] FIRE KINDLER

[75] Inventor: Newton George Leveskis, Auburn, Calif.

[73] Assignee: Custom Research and Development, Inc., Auburn, Calif.

[22] Filed: Jan. 9, 1976

[21] Appl. No.: 647,948

Related U.S. Application Data

[63] Continuation-in-part of Ser. No. 443,565, Feb. 19, 1974, abandoned.

[52] U.S. Cl. ..... 44/41; 44/17; 44/38

[51] Int. Cl.[2] ..... C10L 11/00; C10L 5/02

[58] Field of Search ..... 44/1 R, 1 C, 6, 17, 44/34, 41, 38, 10 A, 10 B, 1 E, 20; 260/610 D

[56] References Cited

UNITED STATES PATENTS

| | | | |
|---|---|---|---|
| 379,490 | 3/1888 | Owen | 44/17 |
| 1,959,472 | 5/1934 | Heffernan et al. | 44/17 X |
| 2,107,054 | 2/1938 | Haymond | 44/41 |
| 2,535,313 | 12/1950 | Mitchell | 260/610 D |

*Primary Examiner*—Carl F. Dees
*Attorney, Agent, or Firm*—Townsend and Townsend

[57] ABSTRACT

Small, effective fire igniter tablets are provided comprising a major amount of a combination of wax and a cellulosic material powder in the form of a tablet or cylinder and a minor amount on and/or near the surface of said tablet or cylinder of an aliphatic diacyl peroxide. The tablets are found to readily ignite and burn for a sufficient time to insure kindling of logs or other solid fuel, both natural and synthetic.

10 Claims, 3 Drawing Figures

FIRE KINDLER

This is a continuation-in-part application of abandoned Ser. No. 443,565 filed Feb. 19, 1974.

BACKGROUND OF THE INVENTION

1. Field of the Invention

Initially fires can be a time consuming and frustrating operation, where the wood is green or damp, or with many hardwoods. For a fire kindler or initiator, the initiator should be safe and readily ingite. Once ignited, the initiator should burn for a sufficiently long time so as to insure the kindling of the log or logs. Therefore, the initiator should be readily formable, provide for good contact between the initiator and the logs. The initiator should burn cleanly and provide a hot flame. In addition, the initiator should be stable during storage, be clean to handle, and should burn uniformly and completely when ignited.

In addition to igniting logs, fire initiators can be employed with coal, briquettes, or other difficultly ignitable fuels. As with wood, the initiator should provide good contact with the fuel and provide a sufficiently hot flame to insure the ignition of the fuel.

2. Description of the Prior Art

U.S. Pat. Nos. 2,007,694; 2,059,208; 2,094,661; 2,854,321 and 3,346,352 and U.S. Pat. Re. No. 15,581 disclose fire kindlers.

SUMMARY OF THE INVENTION

Fire initiators are provided, which may be of any convenient shape, but are preferably cylindrical, comprised of a major amount of a wax-cellulosic powder combination and a minor amount on the surface of an aliphatic, relatively high molecular weight, diacyl peroxide.

DESCRIPTION OF THE SPECIFIC EMBODIMENTS

Figure 1:
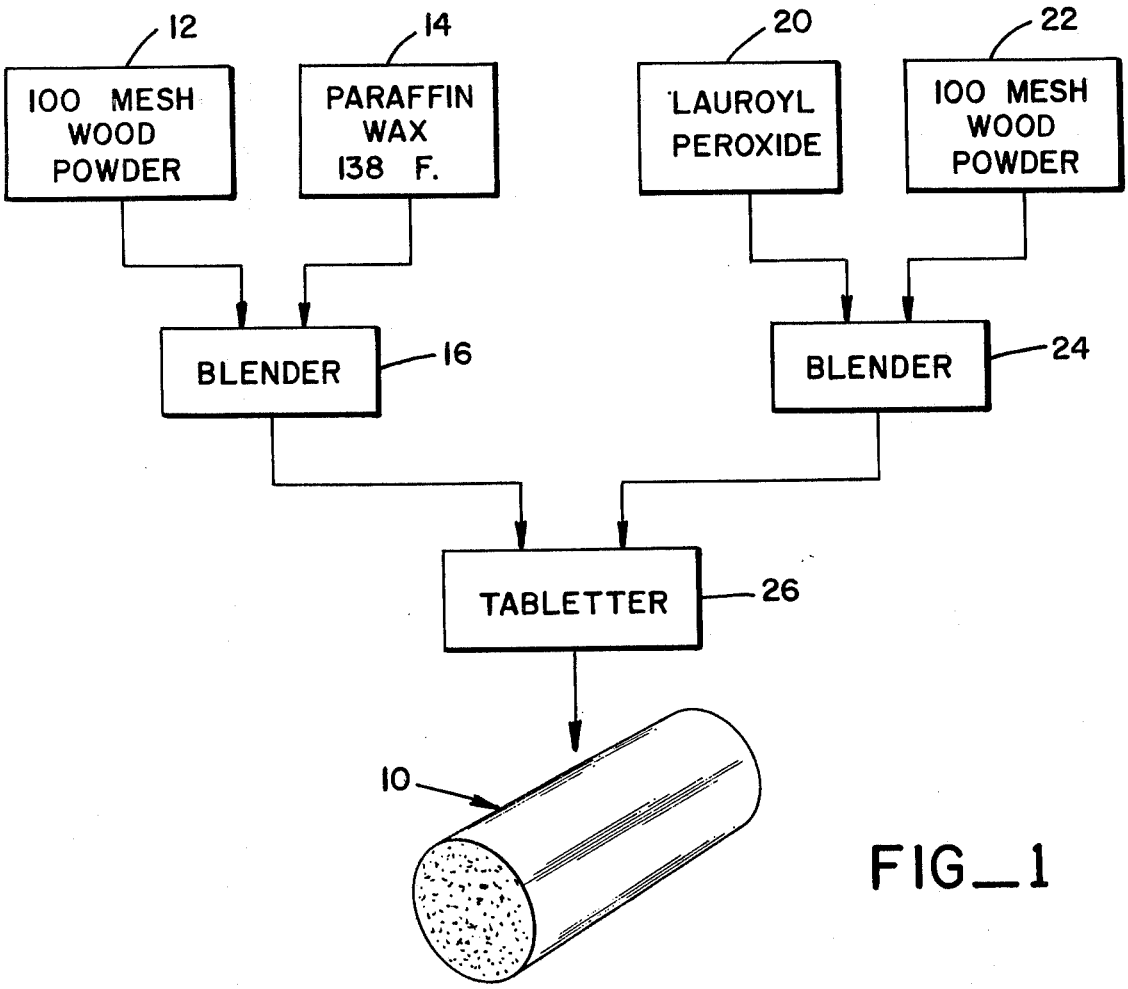
FIG. 1 is a block diagram of a method for preparing fire initiator tablets with a perspective view of such tablet.
Figure 2:
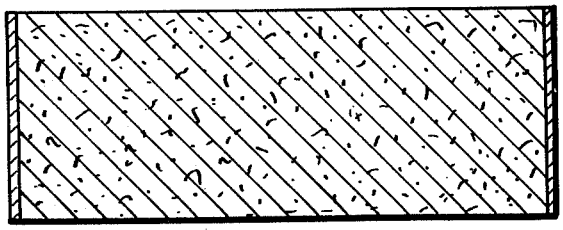
FIG. 2 is a cross-sectional view of a tablet prepared according to FIG. 1.

Fire initiators, particularly useful with logs, briquettes, coal or other particularly difficultly initiated solid fuel, are provided. A compressed tablet is formed having a major amount of a wax-cellulosic powder combination and a minor amount on the periphery or surface of the compressed tablet of a relatively high molecular weight solid diacyl peroxide. The diacyl peroxide may be situated on any convenient portion of the tablet and need only cover a small portion of the total surface of the tablet. The diacyl peroxide may be incorporated on the tablet during formation of the tablet or subsequent to formation of the tablet.

In preparing the tablet, a relatively fine cellulosic powder is first mixed with wax to provide a fairly uniform distribution of the powder and the wax. Once the mixture is formed, it may then be compressed in a tableting machine to provide the desired conformation. Where the peroxide is to be incorporated at the time of formation of the tablet, a small amount of a mixture of cellulosic powder and diacyl peroxide may be introduced into the tableting machine either prior or subsequent to or both prior and subsequent to the introduction of the wax-cellulosic material combination. Upon compression, a tablet is formed having the peroxide at one or both ends of the tablet.

Alternatively, a long rod of the wax-cellulosic material combination can be formed and then cut to the appropriate lengths. The peroxide may then be applied to the resulting tablet by compression, at one or both ends, employing a peroxide-cellulosic powder combination, or may be painted, sprayed, rolled, or the like onto the surface of the tablet. Alternatively, the tablet can be formed with one or more slots along the sides of the tablet, particularly along its longest dimension, and the peroxide-cellulosic powder combination compressed into the slots.

The amount of peroxide by weight of the tablet will normally be from about 0.02 to 1 weight %, usually from about 0.05 to 0.5 weight %, and preferably from about 0.05 to about 0.3 weight %. The area the peroxide will cover of the total surface of the tablet may vary widely, generally being at least about 1% and up to as much as 100%, usually being at least 5% and not greater than about 50%, and preferably being from about 5–20%.

The tablet will generally have a minimum dimension of at least one-half inch and a maximum dimension of 4 inches. Conveniently, cylindrical tablets can be formed having from about ½ to 2 inches in diameter, more usually from about ¾ to 1½ inches in diameter and from about ½ to 4 inches in length, more usually from about ½ to 2 inches in length.

The wax component can be a natural animal or mineral wax, a petroleum wax or a synthetic wax. The preferred wax is a petroleum wax, particularly paraffin wax or microcrystalline wax or mixtures thereof. Among petroleum waxes are slack waxes, refined wax, tank bottoms wax, motor oil wax or the like. Normally, the waxes will have less than about 9.5 weight % oil content.

The melting point temperature of the wax will be at least about 115° F, usually at least about 120° F and not exceeding about 200° F, generally not exceeding about 180° F.

The cellulosic material will normally be wood powder, but may be another source of cellulosic material, such as leaves, straw, nuthulls, shells, rice hulls or the like. The cellulosic material is normally employed as a fine powder, usually 50 U.S. mesh or higher. For purposes of convenience, extremely fine powders will be avoided, because of the difficulties in handling, mixing, and the like. Usually, the powder will be about 50–500 mesh, more usually from about 50–200 U.S. mesh.

The wax-cellulosic powder composition will usually have from about 40 to 80 weight % cellulosic powder (60–20 weight % wax), preferably about 50 to 75 weight % cellulosic powder (25 to 50 weight % wax).

The peroxides which are employed are diacyl peroxides which may be symmetrical or asymmetrical, normally symmetrical. The peroxide will normally have at least about 20 carbon atoms and not more than about 40 carbon atoms, preferably from about 20 to 28 carbon atoms. The acyl groups may vary from 2 to 24 carbon atoms, but are preferably from about 10 to 18 atoms. The acyl peroxides are free of aromatic unsaturation and preferably free of aliphatic unsaturation, and will normally be aliphatic hydrocarbon.

Illustrative diacyl peroxides include butyryl stearoyl peroxide, didecanoyl peroxide, dilauroyl peroxide, dimyristoyl peroxide, distearoyl peroxide, etc.

As previously indicated, the peroxide may be applied to the wax-cellulosic powder combination in a variety of ways. When applied as a solution, the peroxide may be present in from about 10 to 80 weight % of the solution, with various aliphatic hydrocarbon solvents being employed. Illustrative solvents include petroleum ether, hexane, octane, cyclohexane, and the like. That is, aliphatic solvents boiling below about 130° C, preferably boiling below 100° C.

Alternatively, the peroxide may be mixed with cellulosic powder, coming within the same limitations as the cellulosic powder employed with the wax. Normally, there will be at least about 25 weight % of peroxide in the peroxide-cellulosic powder combination and not more than about 90 weight %, preferably being in the range of about 50 to 85 weight % and particularly preferred from about 65 to 80 weight %. The peroxide may then be introduced on the sides or ends of the tablet by compression at elevated pressures, in the range of about 500 to 1,000 psi. Where the peroxide-cellulosic mixture is to be applied to the ends, it need only be introduced during the individual tableting, prior to or after the introduction of the wax-cellulosic powder combination and compressed simultaneously. Where a slot is introduced along the side of the tablet, the peroxide-cellulosic powder combination may be introduced into the slot and then compressed into the slot.

It is found that the peroxides are compatible with the wax, so that a strong bond is obtained between the peroxide-cellulosic powder combination and the wax-cellulosic powder combination. The strong bond insures the integrity of the tablet during packaging and storage and aids in the rapid and uniform initiation of ignition of the fire started, which provides efficient initiation of the fuel, such as a log or coal chunk.

For further understanding of the invention, the drawings will now be considered. In FIG. 1, the process for preparing the fire initiating tablet 10 is indicated diagramatically. A source of 100 mesh wood powder 12 and a source of paraffin wax melting at 138° F 14 is introduced into a blender or a mixer 16 and mixed to provide a substantially uniform distribution of the wood powder in the paraffin wax. Simultaneously, a source of lauroyl peroxide 20 and a source of 100 mesh wood powder 22 is introduced into a blender or mixer 24 in the proper proportions to provide a substantially uniform mixture of the peroxide and the wood powder. In order to have the lauroyl peroxide at both ends of the fire initiator 10, the peroxide-wood powder mix from the blender 24 is first introduced into the tableter 26 in sufficient amounts to substantially cover the bottom of the tableter, providing a thin layer of the lauroyl peroxide-wood powder mix. The layer may be as small as one thirty-second inch and will usually not exceed three-sixteenths inch, generally being from about one thirty-second inch, to one-eighth inch after compression.

The wax-wood powder composition is now introduced over the peroxide-wood powder mixture to the desired level, to provide the appropriate size for the tablet 10. On top of the wax-wood powder composition and the tablet is added a small amount of the peroxide-wood powder composition from blender 24. The material in the tablet is now compressed under an appropriate pressure, usually exceeding about 500 psi and generally less than about 1,000 psi to provide the tablet 10, with its ends 30 and 32 coated with the peroxide-wood powder composition.

As indicated previously, both ends of the tablet need not be coated. It is normally sufficient to have only one end coated with the peroxide. Thus, one need only introduce into the tableter the peroxide-wood mesh composition either initially, prior to the introduction of the wax-wood mesh composition or after the wood mesh-wax composition has been introduced.

Figure 3:
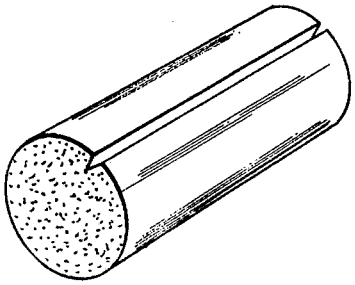
FIG. 3 is a perspective view of an alternative embodiment having a slot along the side of a cylindrical tablet.

As an alternative, one can score the tablet along the sides to introduce a slot, or compress the tablet, whereby one or more slots are provided. One can then introduce the peroxide-wood mesh composition into the slot and compress the peroxide-wood mesh composition to provide a strong bond between the peroxide-wood mesh composition and the wax-wood mesh composition. In FIG. 3, tablet 34 is indicated having a slot running along its side, prior to introduction of the peroxide-wood mesh composition.

Irrespective of the manner in which the peroxide is provided on the surface of the tablet, great efficiency is achieved in the rapid ignition of the fire initiator with efficient kindling of the wax-wood mesh composition. In this manner, the burning of the wax-wood mesh is then capable of initiating difficultly initiatable solid fuels, such as logs, coal, and the like.

Various compositions were prepared of lauroyl peroxide and wood mesh and the time for initiation determined. Initiation was achieved by applying a lighted match to a tablet of about 1.25 inch diameter and 0.5 inch length prepared from 50g of a 1:1 weight ratio of 100 mesh wood powder and 138° F paraffin was supplied by Paragon Refining Co. A thin layer of the lauroyl peroxide-wood powder composition was introduced prior to and subsequent to the wax-wood powder composition in the tableter form and the combination compressed at about 700 psi for 5 sec.

The following table indicates particular ratios of the lauroyl peroxide to 100 mesh wood powder, the time for ignition, and the time required to burn over the top of the tablet.

TABLE I

| Lauroyl peroxide g. | 100 mesh Wood Powder g. | Time to Light sec. | Time to burn over top sec. |
|---|---|---|---|
| 1 | 1 | 5 | 45 |
| 1.5 | 0.5 | 1 | 25 |
| 0.5 | 1.5 | 1.5 | 70 |
| 2 | — | 1 | 43 |
| — | 2 | 24 | 235 |

It is evident from the above table that the peroxide-wood powder mixture is highly efficient in rapidly igniting and providing rapid ignition of the wax-wood powder over a wide area. Furthermore, there is no substantial reduction in efficiency, compared to the peroxide by itself, as one reaches an approximately 1:1 mixture of the peroxide-wood powder composition. In fact, at a 3:1 ratio of peroxide to wood powder, greater efficiency in the rate of ignition is achieved.

To determine the rapidity at which a peroxide would ignite after substantial storage at a moderately elevated temperature, the following experiment was carried out. A mixture was prepared with 75 parts of the peroxide and 25 parts of 100 mesh wood powder. The peroxide mix (1g) was placed in an hydraulic press, followed by adding 5oz of a 1:1 by weight mixture of the previously described wax-wood powder composition. This was followed by an additional 1g of the peroxide mix and the tablet compressed at 750 psi for 5 seconds. The tablet was then stored in an oven at 35° C for 2 weeks. The following table indicates the results.

TABLE II

| Peroxide | Time to light, sec. |
|---|---|
| none | 24 |
| didecanoyl | 24 |
| dilauroyl | 2 |
| dimyristyl | 3 |

It is evident from the above results that the peroxides in combination with the wood powder retain their effectiveness over extended periods of time at moderately elevated temperatures.

The following experiment will demonstrate that the combination of wax and cellulosic powder is essential to achieve the desired combustion and that the proportions must be in accordance with the amounts previously described. The results in the following Table were obtained from an attempt to burn cylinders formed from 100 mesh wood powder and 138° F paraffin wax in the proportions listed. The cylinders were 3 inches in length and 1⅝ inch in diameter and were formed by compressing the components at 750 psi for 5 seconds. Ignition was attempted in a conventional barbecue pit by contact with an ordinary safety match.

TABLE III

| Cylinder Components Parts by Weight | | |
|---|---|---|
| 100 mesh Wood Powder | Wax(138° F) | Results |
| 75 | 25 | About 1" of cylinder burn |
| 50 | 50 | Consumed the whole cylinder |
| 100 | — | Would not burn |
| 20 | 80 | Consumed total cylinder |
| 5 | 95 | Could not ignite |

In accordance with this invention, cellulosic powder-wax compositions are provided which can be readily mixed and compressed to provide a stable tablet. The presence of the peroxide when mixed with the wood powder provides for rapid ignition of the tablet, with rapid migration of the fire on the tablet surface. Furthermore, the peroxide-wood mesh composition provides a strong bond to the wax-wood mesh composition so as to retain the character of the tablet during storage over long periods of time.

Although the foregoing invention has been described in some detail by way of illustration and example for purposes of clarity of understanding, it will be obvious that certain changes and modifications may be practiced within the scope of the appended claims.

What is claimed:

1. A fire kindling tablet comprising a major amount of a wax-cellulosic wood powder composition, wherein said cellulosic wood powder is present in from about 40 to 80 weight percent and having on its surface from about 0.05 to 0.5 weight percent of said tablet of a peroxide-cellulosic wood powder composition comprised of a diacyl peroxide of at least 20 carbon atoms combined with a cellulosic wood powder, said diacyl peroxide being present in from 25 to 90 weight percent of said peroxide-cellulosic wood powder composition, wherein said wax has a melting point in the range of about 115° to 200° F.

2. A tablet according to claim 1, wherein said wood powder is a size less than 50 U.S. mesh, said wax has a melting temperature in the range of about 115° to 180° F and said tablet is formed by compressing together the wax-cellulosic wood powder composition with the peroxide-cellulosic wood powder composition coated on at least one side.

3. A tablet according to claim 2 wherein said diacyl peroxide is lauroyl peroxide.

4. A tablet according to claim 1, wherein said tablet has a minimum dimension of at least one-half inch and a maximum dimension of not more than about 4 inches.

5. A tablet according to claim 1, substantially in the form of a cylinder, wherein said wood powder of a size less than about 50 U.S. mesh, said wax has a melting temperature in the range of 115° to 180° F, and said cylinder is formed by compressing said wax-cellulosic wood powder composition.

6. A tablet according to claim 5, having at least one groove formed along the curved side filled with said peroxide-cellulosic wood powder composition.

7. A tablet according to claim 5, wherein at least one end coated with said peroxide-cellulosic wood powder composition, which is compressed simultaneously with the compression of said wax-cellulosic wood powder composition.

8. A fire kindling tablet comprising a major amount of a wax-cellulosic powder composition, wherein said cellulosic powder is present in from about 40 to 80 weight percent and having on its surface from about 0.05 to 0.5 weight percent of said tablet of a peroxide-cellulosic powder composition comprised of a diacyl peroxide of at least 20 carbon atoms combined with a cellulosic powder, said diacyl peroxide being present in from 25 to 90 weight percent of said peroxide-cellulosic powder composition, wherein said wax has a melting point in the range of about 115° to 200° F.

9. A fire kindling tablet in accordance with claim 8, wherein said cellulosic powder is formed from a member selected from the group consisting of wood, leaves, straw, nuthulls and rice hulls.

10. A fire kindling tablet in accordance with claim 9, wherein said cellulosic material is powder of a size not larger than about 50 U.S. mesh.

* * * * *